US006523505B2

(12) United States Patent
Maute

(10) Patent No.: US 6,523,505 B2
(45) Date of Patent: Feb. 25, 2003

(54) COOLANT AND/OR LUBRICANT TRANSPORT DEVICE

(75) Inventor: Alexander Maute, Hechingen-Stetten (DE)

(73) Assignee: Joma-Polytec Kunststofftechnik GmbH, Bodelshausen (DE)

( * ) Notice: Subject to any disclaimer, the term of this patent is extended or adjusted under 35 U.S.C. 154(b) by 0 days.

(21) Appl. No.: 09/986,817

(22) Filed: Nov. 13, 2001

(65) Prior Publication Data

US 2002/0026907 A1 Mar. 7, 2002

Related U.S. Application Data

(63) Continuation-in-part of application No. 09/548,434, filed on Apr. 12, 2000, now abandoned.

(30) Foreign Application Priority Data

Apr. 19, 1999 (DE) ..... 299 06 797 U
May 6, 1999 (DE) ..... 199 20 798

(51) Int. Cl.[7] ..... F01M 1/02; F01P 7/14

(52) U.S. Cl. ..... 123/41.02; 123/41.44; 123/196 R

(58) Field of Search ..... 123/41.44, 196 S, 123/196 R, 41.02

(56) References Cited

U.S. PATENT DOCUMENTS 5,765,521 A * 6/1998 Stutzle et al. ..... 123/196 S
5,884,601 A * 3/1999 Robinson ..... 123/196 S

FOREIGN PATENT DOCUMENTS

JP 09329560 A * 6/1997 ..... G01N/27/22

* cited by examiner

*Primary Examiner*—Andrew M. Dolinar
(74) *Attorney, Agent, or Firm*—Paul Vincent

(57) ABSTRACT

A coolant and/or lubricant transport device supplies lubricant or circulating cooling water in internal combustion engines. The pump can be driven by an electric motor which can be controlled in dependence upon a control quantity of a continuous controller. The pump can be temporarily stopped or operated to work with an appropriately reduced output to achieve a desired control value.

4 Claims, 1 Drawing Sheet

COOLANT AND/OR LUBRICANT TRANSPORT DEVICE

This application is a continuation in part of U.S. Ser. No. 09/548,434 filed on Apr. 12, 2000 now abandoned, and also claims Paris Convention priority of DE 299 06 797 filed Apr. 19, 1999 and of DE 199 20 798 filed May 6, 1999 the complete disclosure of which are hereby incorporated by reference.

BACKGROUND OF THE INVENTION

The invention concerns a coolant and/or lubricant transport device comprising a pump, which can be driven by a drive, for supplying lubricant or circulating cooling water in combustion engines.

In combustion engines, the lubricant supply pump is usually a toothed wheel pump integrated in the oilpan. The water pump is mounted to the outside of the engine block. Each pump is driven by a chain or a V-belt, powered by the internal combustion engine. Both pumps are therefore permanently connected to the combustion engine and are thereby continuously driven during operation of the internal combustion engine to consume a corresponding amount of energy.

It is therefore the underlying purpose of the invention to effect lubrication and/or circulation of cooling water in internal combustion engines using less energy.

SUMMARY OF THE INVENTION

This object is achieved in accordance with the invention in that the drive is an electric motor, wherein a detection element generates a control quantity in the internal combustion engine with the electric motor being regulated in dependence upon the control quantity via a controller.

Pumps of this type can therefore, in dependence on the control quantity, be temporarily stopped or operated to work with appropriately reduced performance sufficient to guarantee predetermined operation parameters, such as cooling water temperature or a minimum oil throughput. This directed regulation has the substantial advantage that coolant and/or lubricant is circulated only when required. This prolongs the useful lifetime of the coolant and/or lubricant and also increases the actual efficiency of the internal combustion engine, since the pumps are operated only when required. The service life of the pumps themselves is also increased. Moreover, the pumps can be operated at high or increased rotational speeds possibly required for cooling purposes even with slowly running internal combustion engines. With conventional devices, a minimum amount of coolant and/or lubricant must be supplied even during idle operation of the internal combustion engine. This is conventionally achieved through use of a correspondingly large pump. However, excessive amounts are then supplied when the combustion engine runs at high speeds. The coolant and/or lubricant transport device in accordance with the invention therefore facilitates use of smaller pumps.

DESCRIPTION OF THE PREFERRED EMBODIMENT

Figure 1:
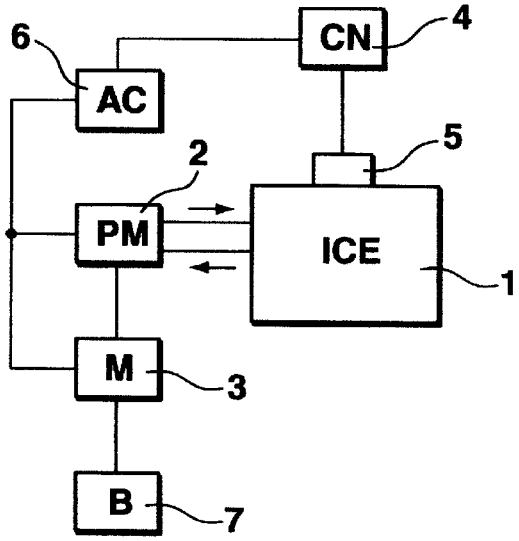
FIG. 1 schematically illustrates operation of the transport device in accordance with the invention.

The pump 2 drive motor 3 is preferably a direct current motor 3 operated at a low voltage, in particular a 12-Volt or 24 -Volt motor powered by a battery 7.

A sensor 5 is advantageously used as the detection element for the controller 4 to measure the control quantity for the lubricant supply and for cooling the engine 1. An actuator 6 can thereby be controlled for regulating the rotational speed of the pump 2.

A moisture sensor 5 has proven to be advantageous for controlling the lubricant supply which can communicate with a running or bearing surface of the internal combustion engine 1 to determine when the lubricant film is sufficient. In another embodiment, the sensor 5 is a temperature sensor which determines temperature changes due to friction and transmits temperature-dependent signals to the controller 4. Sensors of this type are preferentially provided in the area of critical bearing surfaces such as crankshaft bearing surfaces, cylinder bushings or the like.

When the cooling or lubricating pump 2 is a vane-cell pump 2, the angular position or height of the pump vanes can be changed by the actuator 6 for controlling the supplied liquid.

Figure 2:
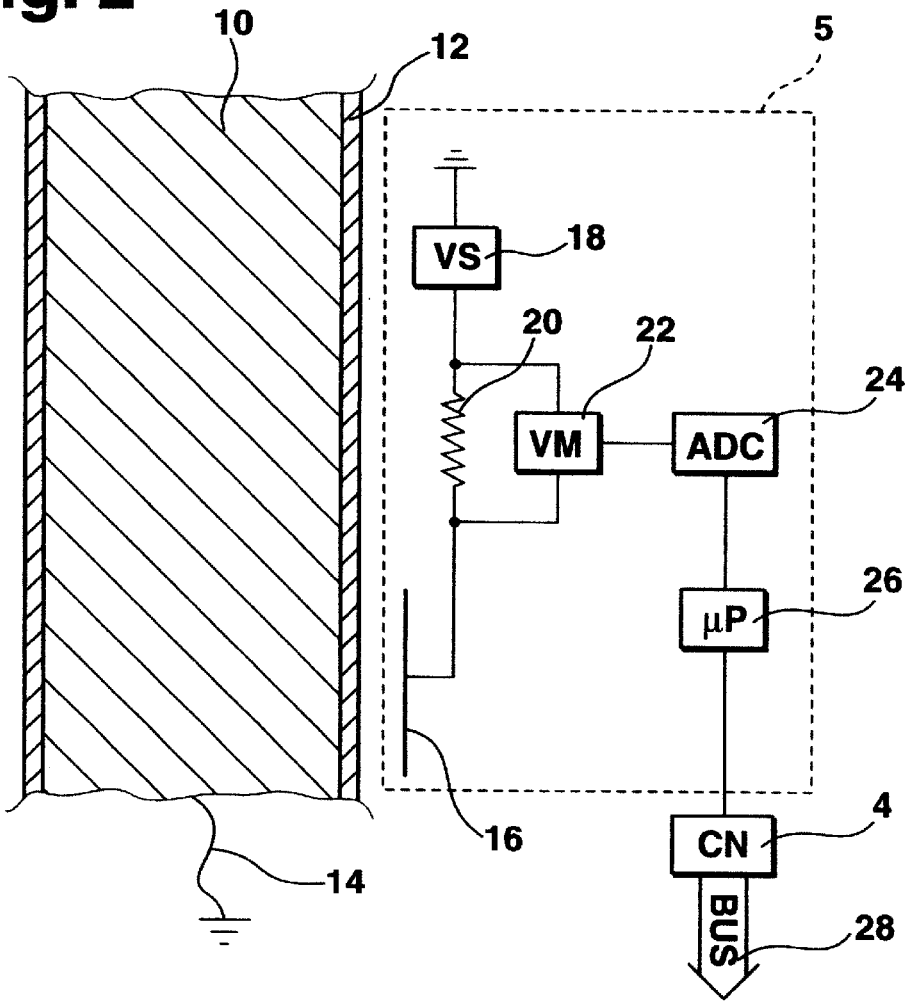
FIG. 2 shows an embodiment of the moisture sensing device in accordance with the invention.

FIG. 2 provides a schematic illustration of an embodiment of the moisture sensor 5 in accordance with the invention. The moisture sensor 5 is positioned proximate a working component 10 which is treated with a lubricant 12, indicated as present on the surface of the working component 10 in FIG. 2. In the embodiment of FIG. 2, it is assumed that the working component 10 is grounded at a position 14. A capacitor plate 16 is positioned in proximity to the working component and the lubricating coating 12 and an alternating voltage source 18 supplies a voltage signal to the capacitor plate 16 via a resistor 20. These components therefore constitute an alternating RC circuit. Due to the effects of the dielectric properties of the lubricant coating 12 which partially fills the capacitor volume defined between the surface of working component 10 and the capacitor plate 16, the current flowing through resistor 20 increases in proportion to the amount of lubricant in coating 12 present between the capacitor plate 16 and the opposing surface of the working component 10. As a result thereof, a voltage signal is produced in resistor 20 which increases in proportion to the amount of oil present in the lubricant coating 12. Voltmeter 22 monitors this voltage and passes the monitored voltage signal to an analog to digital converter 24 for digitization. This digital signal is then passed to microprocessor 26 which generates control signals for communication to controller 14 and, via output bus 28, to other components in the system. The frequency of the alternating voltage source 18, the value of the resistor 20 and the effective geometry between the capacitor plate 16 and the working component 10, in conjunction with the dielectric effects of the lubricant coating 12 can all be chosen in such a fashion that the voltage signal in voltmeter 22 increases monotonically and approximately linearly with the amount of lubricant in the lubricant coating 12. In a preferred embodiment, the capacitor plate 16 is positioned directly downstream of the working surface of the working component 10 such that the lubricant coating 12 must first pass upstream working surfaces of the working component 10 before it can gain access to the capacitor plate 16. The presence of lubricant 12 in the vicinity of the capacitor plate 16 therefore assures its presence immediately upstream thereof. In this way, the presence of a lubricant coating on the working surface can be assured and components of the system such as lubricant pumps and the like can be controlled in dependence on the voltage signal monitored by voltmeter 22.

What is claimed is:

1. A cooling and lubricant transport device for an internal combustion engine, the device comprising:

a pump communicating with the engine to supply a lubricant to the engine;

an electric motor for driving said pump;

a moisture sensor communicating with one of a running and a bearing surface of the engine to directly measure an amount of lubricant film on that running and bearing surface; and a controller communicating with said moisture sensor and with said electric motor for controlling a power output of said electric motor in dependence on said lubricant film amount.

2. The device of claim 1, wherein said electric motor is a direct current motor operated at low voltage.

3. The device of claim 1, further comprising an actuator communicating with said controller and at least one of said electric motor and said pump to regulate a rotational speed of said pump.

4. The device of claim 3, wherein said pump is a vane-cell pump, wherein said actuator changes at least one of an angular position and a height of pump vanes for controlling an amount of supplied liquid.

* * * * *